US007503268B2

(12) United States Patent
O'Connor

(10) Patent No.: US 7,503,268 B2
(45) Date of Patent: Mar. 17, 2009

(54) TRANSPORTABLE INCINERATION APPARATUS AND METHOD

(75) Inventor: Brian M. O'Connor, Palm City, FL (US)

(73) Assignee: Air Burners LLC, Palm City, FL (US)

( * ) Notice: Subject to any disclaimer, the term of this patent is extended or adjusted under 35 U.S.C. 154(b) by 434 days.

(21) Appl. No.: 11/315,609

(22) Filed: Dec. 22, 2005

(65) Prior Publication Data

US 2007/0144412 A1 Jun. 28, 2007

(51) Int. Cl.
*F23G 7/00* (2006.01)

(52) U.S. Cl. ..... 110/240; 110/241

(58) Field of Classification Search ..... 414/495; 280/789; 110/346, 241, 317, 240
See application file for complete search history.

(56) References Cited

U.S. PATENT DOCUMENTS

| | | | | |
|---|---|---|---|---|
| 822,839 | A | | 6/1906 | Fry |
| 1,231,535 | A | | 6/1917 | Jones |
| 1,597,713 | A | | 8/1926 | Bishop |
| 3,472,454 | A | | 10/1969 | Blue et al. |
| 3,682,115 | A | | 8/1972 | Rodgers |
| 3,699,904 | A | | 10/1972 | Brown et al. |
| 3,785,302 | A | * | 1/1974 | Davis ..... 110/215 |
| 3,785,303 | A | | 1/1974 | Hopkins |
| 3,808,985 | A | | 5/1974 | Raber |
| 3,869,994 | A | | 3/1975 | Von Berlichingen |
| 3,945,370 | A | | 3/1976 | Essington |
| 4,000,705 | A | | 1/1977 | Raber |
| 4,241,671 | A | | 12/1980 | Joyner et al. |
| 4,688,494 | A | | 8/1987 | Domnitch |
| 4,739,712 | A | | 4/1988 | McPherson |
| 4,756,258 | A | | 7/1988 | Gilbert |
| 4,771,709 | A | | 9/1988 | Applegate |
| 4,834,002 | A | | 5/1989 | LaChance |
| 4,870,948 | A | * | 10/1989 | Wallace ..... 126/224 |
| 4,889,061 | A | * | 12/1989 | McPherson et al. ..... 110/336 |
| 4,898,106 | A | | 2/1990 | Bellew et al. |
| 5,020,452 | A | | 6/1991 | Rybak |
| 5,050,509 | A | | 9/1991 | Mormino |
| 5,152,233 | A | | 10/1992 | Spisak |
| 5,237,938 | A | | 8/1993 | Fujimori et al. |
| 5,325,795 | A | | 7/1994 | Nelson et al. |
| 5,415,113 | A | | 5/1995 | Wheeler et al. |
| 5,522,582 | A | * | 6/1996 | Dilks ..... 254/323 |
| 5,626,087 | A | | 5/1997 | Lompa |
| 5,699,745 | A | | 12/1997 | Kaehr |

(Continued)

FOREIGN PATENT DOCUMENTS

SE 0496309 A1 * 7/1992

(Continued)

*Primary Examiner*—Kenneth B Rinehart
(74) *Attorney, Agent, or Firm*—Hodgson Russ LLP

(57) ABSTRACT

A transportable incineration apparatus for burning wood and green waste comprises a trailer and a firebox mounted on the trailer by a suspension system operable to lift the firebox off of the ground for transport and to set the firebox onto the ground for incineration. The wheels of the trailer are mounted on independent torsion axles to increase the space available for the firebox. A system for generating an air curtain overtop the firebox reduces pollution resulting from incineration. The apparatus may be towed to an incineration location and used with minimal set up and take down time.

7 Claims, 4 Drawing Sheets

U.S. PATENT DOCUMENTS 5,727,481 A 3/1998 Voorhees et al.
5,799,597 A 9/1998 Kaehr
5,810,544 A * 9/1998 Wellman ..... 414/495
6,003,814 A * 12/1999 Pike et al. ..... 244/134 B
6,352,040 B1 3/2002 Voorhees et al.
6,749,387 B1 * 6/2004 Saxer et al. ..... 414/458

FOREIGN PATENT DOCUMENTS

WO WO 92/20965 11/1992

* cited by examiner

TRANSPORTABLE INCINERATION APPARATUS AND METHOD

FIELD OF THE INVENTION

The invention relates to the field of waste disposal, and in particular waste disposal by incineration.

BACKGROUND OF THE INVENTION

Incinerating waste is a known alternative to burying waste or transporting it to another location. In order to reduce ash and smoke released during waste incineration (particulate release), a flow of high velocity air has been used to provide an "air curtain" over a fire pit or firebox in which the waste is burned.

U.S. Pat. Nos. 4,739,712; 4,756,258; and 6,766,750 disclose towable apparatus comprising a fan and manifold assembly that can be located at the edge of a fire pit, such as may be found at a landfill site. In some locations, however, it is not possible or permissible to dig a fire pit, for example locations having a high water table, hard rock layers, sandy soil, or large tree root systems.

U.S. Pat. No. 5,415,113 describes a portable apparatus for air curtain incineration comprising a firebox, fan, and manifold assembly mounted on a support frame having underlying skids, whereby the apparatus may be loaded onto a flatbed truck for transport to a desired site, for example a development site where vegetation is being cleared. While this portable apparatus removes the need for digging a fire pit, it requires the use of a flatbed truck, and significant time and effort are required each time the apparatus is loaded onto or unloaded from the truck. Maneuverability of a flatbed truck into confined or steep areas also presents a problem in some cases.

Many wildfire prone communities of the Western United states have programs that require property owners to remove excess vegetation and green waste from their property to help prevent or contain forest fires. As a result, local landfills are becoming overburdened with green waste which uses up valuable landfill space.

In agricultural settings, green waste is generated by clearing, trimming, and pruning operations. In a grove where fruit or nut trees must be removed due to disease or infestation, it is undesirable to uproot and haul the affected trees to a clearing because this may spread the disease or infestation to healthy trees along the way.

Therefore, a need exists for an environmentally friendly incineration apparatus which is highly portable, does not require a fire pit, can be towed by a conventional pickup truck or other vehicle, involves minimal set up and take down time, and is sized to reach locations that larger incineration apparatus cannot reach.

SUMMARY OF THE INVENTION

Therefore, it is an object of the present invention to provide a trailer-mounted air curtain incineration apparatus that uses a firebox instead of a trench, but does not require unloading and loading of a firebox at each location it is used.

It is another object of the present invention to provide an air curtain incineration apparatus that is sized for towing to locations that are difficult to reach with larger sized portable fireboxes.

In furtherance of these and other objects, an incineration apparatus formed in accordance with an embodiment of the present invention generally comprises a trailer including a frame having a pair of opposite side members extending in a longitudinal direction of the trailer, a pair of independent wheel axles extending one from each of the pair of side members such that space between the pair of side members is unoccupied by the pair of wheel axles, a pair of wheels mounted one to each of the pair of wheel axles, a firebox arranged between the pair of side members, and suspension means for raising and lowering the firebox relative to the pair of side members to lift the firebox off of the ground for transport and to set the firebox onto the ground for incineration. The suspension means may comprise a winch and cable operatively coupled to the firebox through a series of pulleys to raise and lower he firebox. Alternatively, the suspension means may comprise a plurality of linear actuators acting between the trailer frame and the firebox for adjusting the vertical position of the firebox. Other suspension means may be used, such as linkage mechanisms. A supplemental support system is preferably provided to support the firebox while the apparatus is being towed.

A manifold assembly is preferably provided along a top side edge of the firebox for discharging high velocity air flow to generate an air curtain overtop the firebox in order to reduce particulate pollution. The manifold assembly may be arranged in communication with a fan mounted on the trailer frame, wherein the fan is powered by a drive unit, such as a diesel engine. Alternatively, the manifold assembly may include a series of internal fans powered by a drive unit mounted on the trailer frame.

The invention also provides a method of incinerating waste comprising the steps of towing a trailer to an incineration location, the trailer supporting a firebox connected thereto; lowering the firebox onto the ground without disconnecting the firebox from the trailer; placing the waste into the firebox; igniting the waste to start combustion thereof; generating an air curtain overtop the firebox; terminating the combustion; and raising the firebox off of the ground after combustion is terminated, the firebox remaining connected to the trailer.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
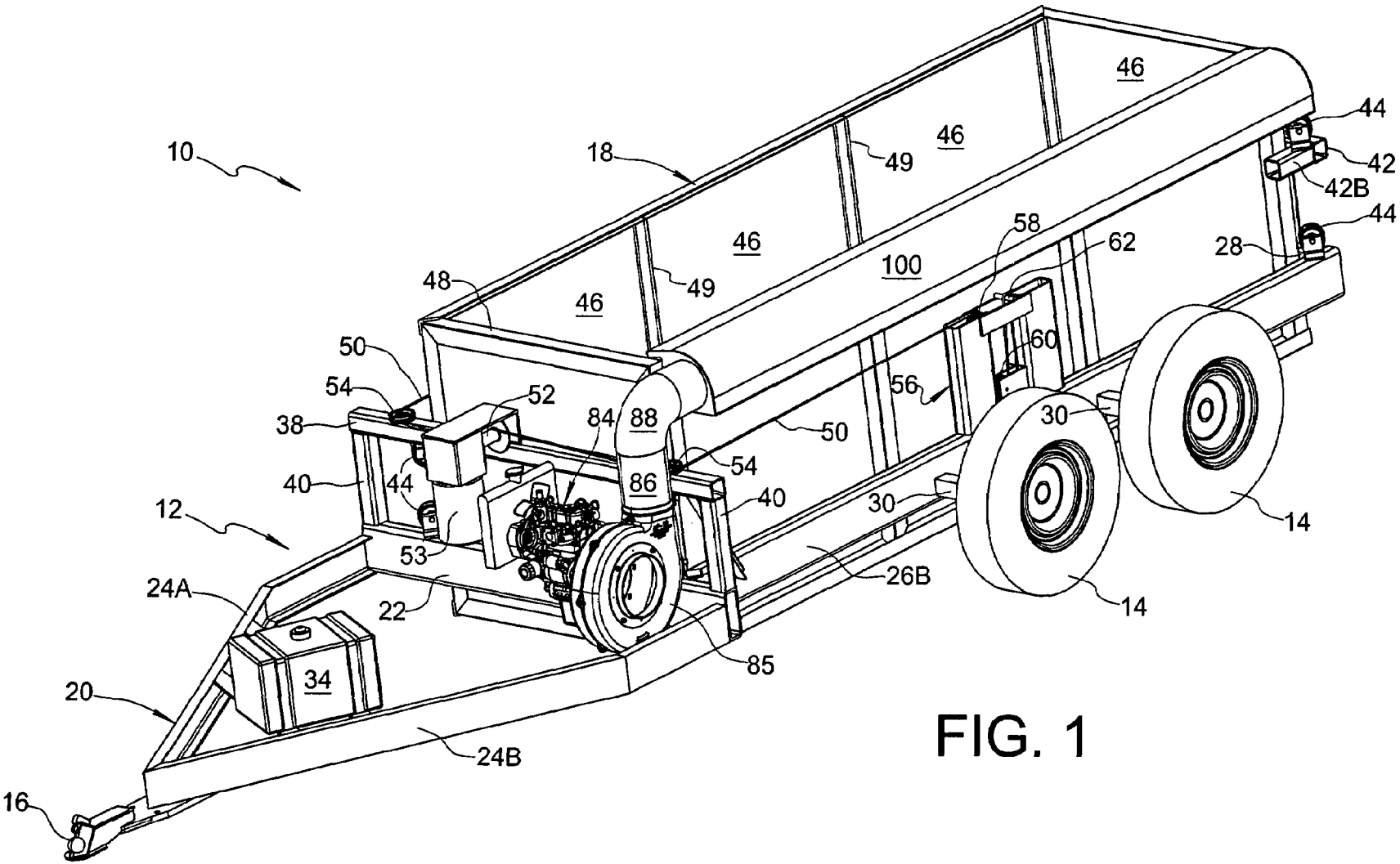
FIG. 1 is a perspective view of a transportable incineration apparatus formed in accordance with an embodiment of the present invention, wherein a front cover is omitted to permit internal structure to be viewed.

Reference is made initially to FIG. 1, which shows a portable apparatus 10 for burning waste. Apparatus 10 generally comprises a trailer 12 having wheels 14 and a front hitch coupling 16 for connecting the trailer 12 to a vehicle, such as a truck (not shown), and a firebox 18 mounted on trailer 12 for containment of burning waste.

Figure 2:
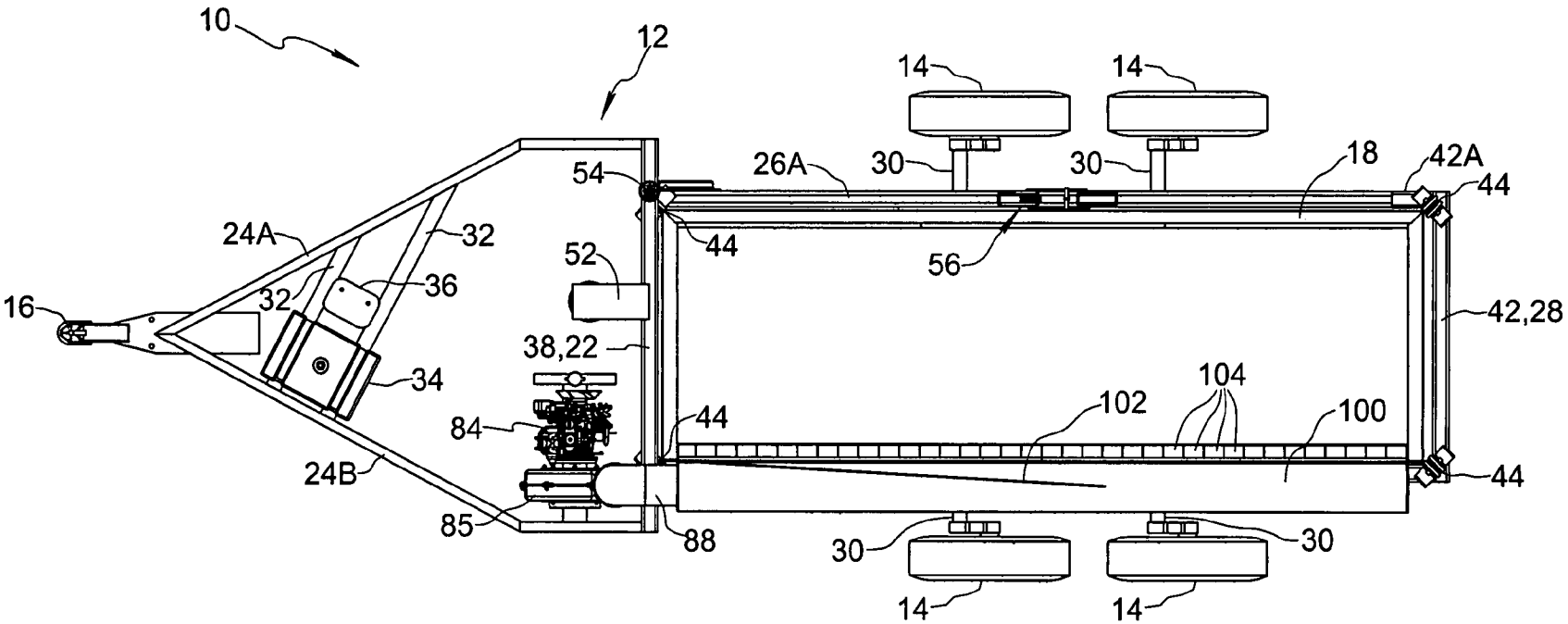
FIG. 2 is a top plan view of the transportable incineration apparatus shown in FIG. 1.
Figure 3:
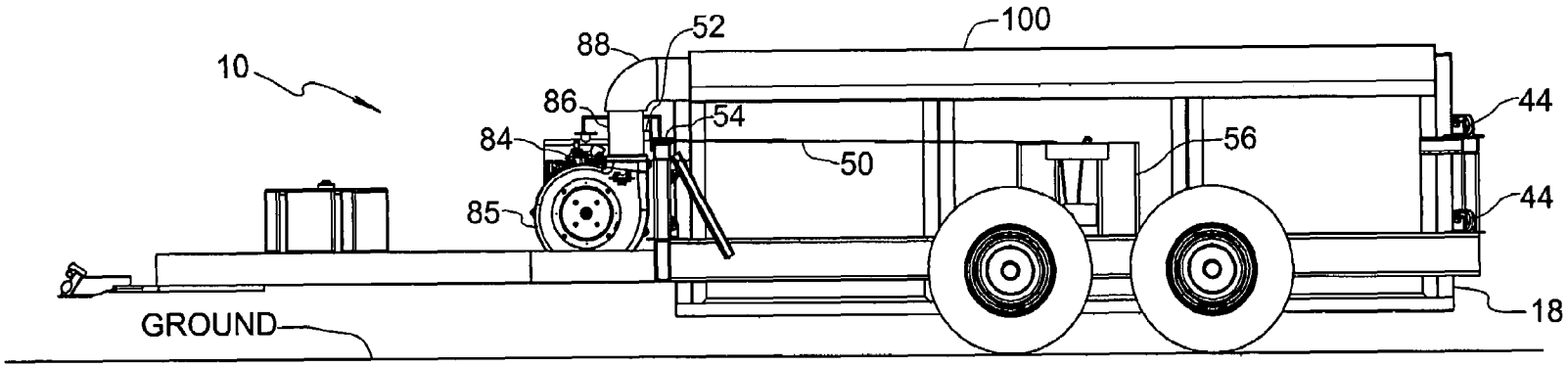
FIG. 3 is a side elevational view of the transportable incineration apparatus shown in FIG. 1, wherein a firebox of the apparatus is illustrated in a raised position thereof.
Figure 4:
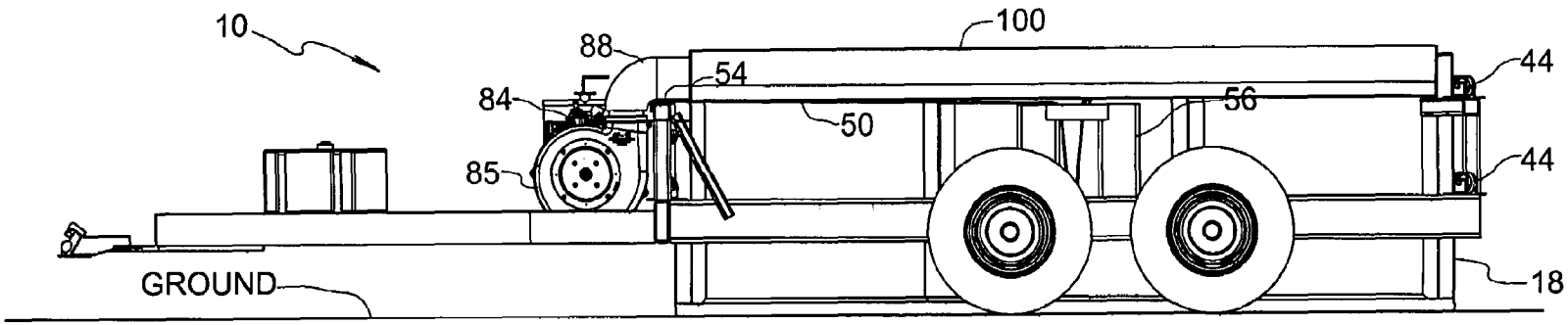
FIG. 4 is a view similar to that of FIG. 3, however the firebox is illustrated in a lowered ground-engaging position thereof.

FIG. 1 shows apparatus 10 without cover panels on a front portion of trailer 12 so that internal structure is exposed to view. Trailer 12 includes a frame 20 having a front frame portion and a rear frame portion joined at shared frame member 22. The front frame portion includes converging side members 24A and 24B that meet at a forward location where hitch coupling 16 is attached to the trailer. As best seen in FIG. 2, the rear frame portion includes a pair of parallel side members 26A and 26B extending rearward from shared frame member 22, and a transverse back member 28 connecting the trailing ends of side members 26A and 26B.

In order to provide an open area in frame 20 for accommodating firebox 18, wheels 14 are preferably mounted on respective independent torsion axles 30 fixed to the outside of each side member 26A, 26B. Independent torsion axles 30 may be formed by cutting a commercially available torsion axle and welding the cut-off portion to the associated side member 26A or 26B. A torsion axle suitable for modification and use on trailer 12 is sold by Quality Trailer Inc. of Salem, Ohio under the trademark EQUALIZER, part number "EC70" (indicating a torsion axle with 7000 lb capacity). By avoiding the use of full length transverse axles each mounting a pair of wheels, and instead using an independent axle for each wheel, the open area available to receive firebox 18 may be increased. However, the present invention may also be practiced using a trailer having one or more transverse axles.

Support members 32 are preferably arranged to extend between converging side members 24A and 24B to provide support for a fuel tank 34, a battery 36, a tool box (not shown), a control panel (not shown), or other equipment that may be useful to operate or service apparatus 10. An equipment support rail 38 is mounted on upstanding posts 40 to extend parallel to and above shared frame member 22. Likewise, a support rail 42 may be provided parallel to and above transverse back member 28. Support rail 42 preferably includes short legs 42A and 42B helping to define rear corners of frame 20.

The trailer 12 further includes a plurality of firebox guide rollers 44 mounted on frame 20 and positioned to tangentially engage firebox 18. Preferably, an upper and lower guide roller 44 are provided at each corner. Guide rollers at the front of firebox 18 may be fixed to shared frame member 22 and equipment support rail 38; guide rollers at the rear of firebox 18 may be fixed to the respective junctions of transverse back member 28 with members 26A, 26B and to the corners of support rail 42. Guide rollers 44 serve to limit contact area between firebox 18 and trailer frame 20 to minimize heat transfer between the firebox and frame, maintain alignment of the firebox with respect to the frame, and reduce friction between the firebox and frame incident to upward and downward movement of the firebox relative to the frame as will be described hereinafter.

Firebox 18 is preferably rectangular in shape and is constructed of a plurality of panels 46 made of a castable thermoceramic material. The panels are situated in a firebox frame 48 and welded together, with a compressible material 49 being provided between the individual panels 46 to accommodate thermal expansion and contraction. In a preferred embodiment, panels 46 measure 4 ft.×4 ft., and three panels are joined along the sides of the firebox and one panel is used at each opposite end of the firebox. The bottom of firebox 18 is open to the ground, and the top of firebox 18 is open to the sky.

In accordance with the present invention, firebox 18 is adjustably connected to frame 20 for upward and downward movement relative to the frame, and a suspension means is provided for raising and lowering the firebox relative to the frame so that the firebox can be quickly and easily lifted off of the ground for transport and set onto the ground for incineration, all while maintaining connection between the frame and the firebox. As will be appreciated, this feature allows fast setup and take down of incineration apparatus 10 to facilitate incineration at different locations. For example, when land is being cleared, incineration apparatus 10 can be quickly moved from location to location on the site to incinerate wood and green waste where it is produced.

In one embodiment, the suspension means includes a cable 50 and a winch 52. The winch 52, which is preferably driven by a DC powered drive motor 53 but may also be a manual winch, is mounted on equipment support rail 38 between a pair of first pulleys 54 mounted at opposite lateral ends of the equipment support rail. Cable 50 is double-wound about the drum of winch 52 such that rotation of the winch drum in one direction will let out both ends of the cable, and rotation of the winch drum in an opposite direction will take up both ends of the cable. Each end of cable 50 is routed through a respective first pulley 54 to extend along a respective side of firebox 18. A pulley support 56 is fixed to each side member 26A, 26B at a location along the side member in the vicinity of, and preferably between, wheel axles 30 on that side. Each pulley support 56 supports a second pulley 58 receiving cable 50 from an associated first pulley 54 and redirecting the cable generally downward. A third pulley 60, which may be mounted on an axle block welded to an outside surface of a middle panel 46 of firebox 18, is arranged below the second pulley 58 to receive cable 50 from the second pulley and redirect the cable upward to a take-up bar 62 fixed to pulley support 56 opposite second pulley 58. The respective end of cable 50 is routed over take-bar and secured to frame 20. Consequently, winch 52 may be rotated in one direction to take up cable 50 on the winch drum by winding, whereby cable 50 exerts an upward force on firebox 18; and winch 52 may be rotated in an opposite direction to unwind cable from the winch drum to ease the firebox in a downward direction under gravity. In this way, firebox 18 may be quickly and easily lifted off of the ground and set onto the ground, without disconnecting the firebox from trailer 12. Winch motor 53 may be powered by battery 36 (connecting wires not shown) and connected to a fixed or portable control unit (not shown) to control speed and direction of winding.

Of course, the number of winches and cables used in the suspension means, and their locations, may be varied as a design choice depending upon loading requirements and other factors.

Figure 5:
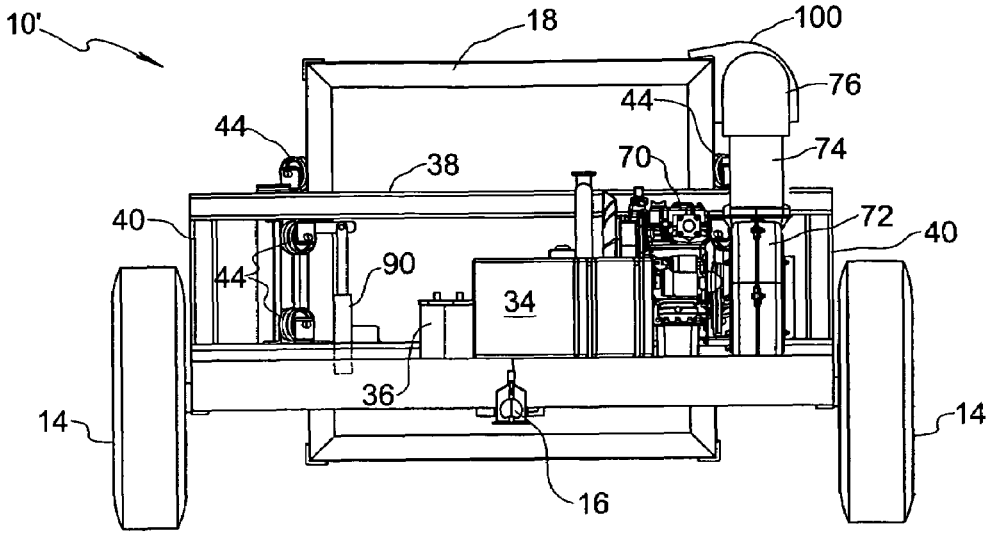
FIG. 5 is a front elevational view of a transportable incineration apparatus formed in accordance with another embodiment of the present invention.

FIG. 5 depicts a transportable incineration apparatus 10' according to an alternative embodiment wherein a plurality of linear actuators 90 are substituted for the cable and winch as suspension means. The actuators may be coupled to frame 20 and firebox panels 46 to raise and lower the firebox. Actuators 90 may be electro-mechanical actuators operating in response to control signals from actuator control electronics (not shown), hydraulic actuators operated by a hydraulic actuator control system (not shown), or pneumatic actuators operated by a pneumatic actuator control system (not shown). Preferably, an actuator 90 is located near each of the corners of firebox 18, and additional actuators may be provided as necessary.

Other alternatives are available as possible suspension means. By way of non-limiting example, a power-driven linkage mechanism (not shown) may be used to raise and lower firebox 18.

Figure 6:
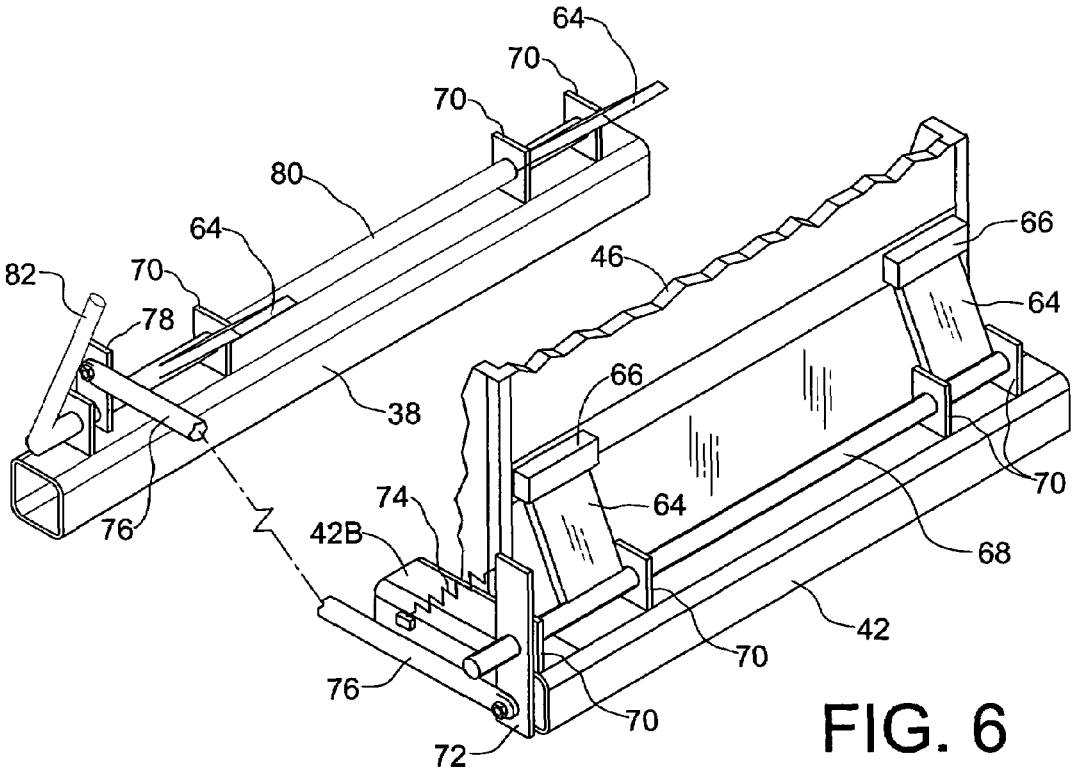
FIG. 6 is a perspective view showing a supplemental firebox support system formed in accordance with an embodiment of the present invention.

Apparatus 10 is preferably provided with a supplemental support mechanism on trailer 12 for bearing the load of firebox 18 during transport so as to reduce stress and wear on the suspension means, thereby providing a higher degree of travel safety. A supplemental support system formed in accordance with a current embodiment is shown in FIG. 6, but omitted from the other figures. The supplemental support system includes a plurality catch members 64 each for engaging the underside of a corresponding lug 66 fixed to an outer surface of firebox 18. In the illustrated embodiment, a pair of lugs 66 are provided on a rear panel 46 of firebox 18 near the rear corners of the firebox, and another pair of lugs 66 (not shown) are provided on a front panel 46 of firebox 18 near the front corners of the firebox. Catch members 64 for engaging lugs 66 on the rear panel are fixed to a rear actuator bar 68 extending transversely along the rear of frame 20 such that the catch members rotate together with the rear actuator bar, which is supported for rotation by bearing plates 70 fixed to rear support rail 42. A lever arm 72 is also fixed to rear actuator bar 68 near an end of the rear actuator bar for exerting torque to rotate the rear actuator bar. A spring 74 is attached to act between support rail leg 42B and a location on lever arm 72 spaced from the axis of rotation of rear actuator bar 68, whereby the rear actuator bar is rotationally biased to bring the distal end of each rear catch member 64 toward engagement with its corresponding lug 66. A link bar 76 connects an opposite end of lever arm 72 to a driving lever arm 78 fixed to a transversely extending front actuator bar 80 supported for rotation by bearing plates 70 fixed to equipment support rail 38. The front actuator bar carries a pair of catch members 64 for engaging corresponding lugs (not shown) on a front panel 46 of firebox 18. A hand lever 82 is provided at an end of front actuator bar 80. As will be appreciated, the force of spring 74 on lever arm 72 is transmitted through link bar 76 and driving lever arm 78 to rotationally bias front actuator bar 80 in a direction bringing the distal end of each front catch member 64 toward engagement with its corresponding lug 66. In order to counter the force of spring 74 and bring the catch members 64 out of engagement with lugs 66, hand lever 82 may be pulled generally counterclockwise as viewed in FIG. 6, thereby allowing firebox 18 to be lowered using winch 52 until the lugs 66 are below the distal ends of catch members 64, at which point the hand lever 82 may be released. When firebox 18 is raised back up, the lugs will deflect the catch members outward as they pass, and then the catch members will spring into place for engaging the underside of the corresponding lug 66, somewhat in the manner of a pawl mechanism.

While not shown in the drawings, it is contemplated to provide stops on frame 20 arranged for engagement by detents tabs on firebox 18 to limit the extent of travel possible by firebox 18 in the upward direction.

Incineration apparatus 10 is preferably provided with means for generating a curtain of air overtop firebox 18 for reducing pollution. For this purpose, a drive unit 84 is mounted to frame 20 and connected to a fan or blower 85 to provide a source of high velocity air which is communicated though duct portions 86 and 88 to a manifold assembly 100 arranged along a top side edge of firebox 18. Drive unit 84 is preferably a fuel burning engine, most preferably a diesel engine. A diesel engine available from Kubota Engine America under designation Z-482 is suitable for practicing the present invention. Drive unit 84 may also be an electrically powered motor. The fan or blower 85 is preferably a centrifugal fan, however other types of fans or blowers may be used. As used herein, including usage in the claims, the term "fan" shall include, without limitation, all forms of blowers, fans, and devices for moving air. In the illustrated embodiment, drive unit 84 is located closely adjacent fan 85 and connected to fan 85 in a manner providing direct drive of the fan by the drive unit.

Duct portions 86 and 88 channel the high velocity air to manifold assembly 100. It will be realized that a variety of duct constructions are possible, keeping in mind that upward and downward movement of the manifold assembly 100 attached to firebox 18 must be accommodated. For example, ducts and duct portions of a flexible and/or accordion design may be used so that communication between the fan 85 and the manifold assembly 100 is maintained regardless of the vertical position of firebox 18 and manifold assembly 100. As an alternative, duct portions 86 and 88 may be sized to accommodate vertical movement of firebox 18 and manifold assembly 100 by telescopic insertion of one portion within the other. As another alternative, the duct portion 86 and/or 88 may be mounted to pivot or move out of communication with the other, or to detach completely for storage, when not in use.

Manifold assembly 100 is generally tubular and comprises an internal diverter 102 extending from the entrance to the manifold assembly to a location more than halfway along the manifold assembly. Diverter 102 partitions the air flow from exit nozzles 104 provided along the manifold assembly facing generally overtop firebox 18, such that air flow is initially diverted away from nozzles 104. In this way, a tuning chamber is created to evenly balance the airflow discharged from nozzles 104. Nozzles 104 are directed slightly into firebox 18 and sized to achieve an even distribution of air, whereby a curtain of air is created overtop the firebox to trap smoke particles momentarily so they may be re-burned to further reduce particle size. As a result, release of 2.5 micron size airborne particles, considered dangerous by the U.S. Environmental Protection Agency, is significantly reduced. Manifold assembly 100 may be constructed generally as taught in U.S. Pat. No. 5,415,311 at column 5, line 43 through column 6, line 63, which disclosure is hereby incorporated herein by reference, with design adjustments being made to adjust for firebox size.

As an alternative for generating an air curtain, it is contemplated to mount a plurality of "squirrel cage" fans within a tubular manifold assembly along a common drive shaft, and to connect an exposed end of the drive shaft to drive unit 84 by suitable transmission elements (belts, gears, pulleys, etc.). This arrangement would avoid the need for diverter 102 and external fan 85.

Apparatus 10 of the present invention may be towed to an appropriate location, and then disconnected from the towing vehicle. To set up for incineration, the suspension means is operated to lift firebox 18 by a slight amount, hand lever 82 is operated to disengage catch member 64 from lugs 66, and the suspension means is again operated to lower firebox 18 onto the ground without disconnecting the firebox from the trailer. Then, waste is placed into the firebox and ignited to start combustion. Drive unit 84 is started to drive fan 85 to generate an air curtain overtop the firebox while combustion takes place. Once combustion is terminated, either naturally by exhaustion of waste fuel or purposely by extinguishing combustion, the suspension means is operated to raise the firebox off the ground until lugs 66 pass catch members 64 and then lower the firebox such that the lugs are engaged by the catch members. Apparatus 10 may then be reconnected to a towing vehicle and towed away from the incineration location, leaving behind a pile of ashes. As will be appreciated, the incineration procedure does not involve disconnecting or reconnecting firebox 18 from trailer 12, resulting in great time savings and ease of operation.

REFERENCE NUMERAL LIST

| | |
|---|---|
| 10 | Transportable incineration apparatus |
| 12 | Trailer |
| 14 | Wheel |
| 16 | Hitch coupling |
| 18 | Firebox |
| 20 | Trailer frame |
| 22 | Shared frame member |
| 24A, 24B | Converging side members of frame |
| 26A, 26B | Longitudinal side members of frame |
| 28 | Transverse frame member (rear) |
| 30 | Independent axle |
| 32 | Equipment support member |
| 34 | Fuel tank |
| 36 | Battery |
| 38 | Equipment support rail |
| 40 | Upstanding post |
| 42 | Support rail (rear) |
| 42A, 42B | Legs of support rail 42 |
| 44 | Guide roller |
| 46 | Firebox panels |
| 48 | Firebox frame |
| 49 | Compressible material between panels 46 |
| 50 | Cable |
| 52 | Winch |
| 53 | Winch motor |
| 54 | First pulley |
| 56 | Pulley support |
| 58 | Second pulley |
| 60 | Third pulley |
| 62 | Take-up bar |
| 64 | Catch member |
| 66 | Lug |
| 68 | Rear actuator bar |
| 70 | Bearing plate |
| 72 | Lever arm |
| 74 | Spring |
| 76 | Link bar |
| 78 | Driving lever arm |
| 80 | Front actuator bar |
| 82 | Hand lever |
| 84 | Drive unit |
| 85 | Fan |
| 86 | Duct portion |
| 88 | Duct portion |
| 90 | Linear actuator |
| 100 | Manifold assembly |
| 102 | Diverter |
| 104 | Nozzle |

What is claimed is:

1. An apparatus comprising:

a trailer including a frame having a pair of opposite side members extending in a longitudinal direction of the trailer;

a pair of independent wheel axles extending one from each of the pair of side members, whereby space between the pair of side members is unoccupied by the pair of wheel axles;

a pair of wheels mounted one to each of the pair of wheel axles;

a firebox arranged between the pair of side members;

an air curtain manifold mounted along a top edge of the firebox;

a fan mounted on the trailer frame;

a duct system communicating from the fan to the manifold; and suspension means for raising and lowering the firebox relative to the pair of side members, the suspension means being operable to lift the firebox off of the ground and to set the firebox onto the ground while the duct system maintains communication between the fan and the manifold, wherein the suspension means includes a winch fixed to the trailer and at least one cable connecting the winch to the firebox, wherein the at least one cable consists of only a single cable double-wound on a drum of the winch, the single cable being attached to opposite sides of the firebox.

2. The apparatus according to claim 1, wherein the winch is a DC powered winch, and the apparatus further comprises a battery mounted on the frame for powering the winch.

3. The apparatus according to claim 1, further comprising a plurality of guide rollers mounted on the trailer and arranged in rolling engagement with the firebox to reduce friction when the firebox is raised and lowered by the suspension means.

4. The apparatus according to claim 1, further comprising at least one catch member biased for engaging a lug fixed to the firebox for releasably supporting the firebox in a raised position off the ground.

5. The apparatus according to claim 1, further comprising air curtain means for blowing a curtain of air overtop the firebox when the firebox is on the ground.

6. The apparatus according to claim 5, wherein the air curtain means includes a drive unit mounted on the frame, a fan driven by the drive unit, and a manifold in communication with the fan when the firebox is on the ground, the manifold having a plurality of air nozzles arranged along a top edge of the firebox for directing airflow overtop the firebox.

7. The apparatus according to claim 6, wherein the engine is a diesel engine.

* * * * *